US005558108A

United States Patent [19]

Croswell, Sr.

[11] Patent Number: 5,558,108

[45] Date of Patent: Sep. 24, 1996

[54] PROCESS FOR REMOVING ZEBRA MUSSELS FROM RIGID STRUCTURES

[76] Inventor: Ted B. Croswell, Sr., 11555 Foster Rd., Baton Rouge, La. 70811-1218

[21] Appl. No.: 369,423

[22] Filed: Jan. 6, 1995

[51] Int. Cl.[6] ..... B08B 9/02; B08B 9/06

[52] U.S. Cl. ..... 134/22.12; 134/22.15

[58] Field of Search ..... 134/22.12, 22.15; 422/26

[56] References Cited

U.S. PATENT DOCUMENTS

| | | | |
|---|---|---|---|
| 4,324,784 | 4/1982 | Naito et al. | 424/130 |
| 4,581,074 | 4/1986 | Mankina et al. | 134/22.15 |
| 5,062,967 | 11/1991 | Muia et al. | 210/755 |
| 5,069,722 | 12/1991 | Murphy | 134/22.12 |
| 5,096,601 | 3/1992 | Muia et al. | 210/755 |
| 5,128,050 | 7/1992 | Gill | 210/755 |
| 5,148,777 | 9/1992 | Brockhurst | 123/41.15 |
| 5,152,637 | 10/1992 | Wayne | 405/127 |
| 5,192,451 | 3/1993 | Gill | 210/755 |
| 5,240,674 | 8/1993 | Armor | 422/6 |
| 5,294,351 | 3/1994 | Clum et al. | 210/774 |
| 5,389,266 | 2/1995 | Clum et al. | 134/19 |

FOREIGN PATENT DOCUMENTS

| | | | |
|---|---|---|---|
| 259082 | 12/1969 | U.S.S.R. | 134/22.15 |

*Primary Examiner*—Neil McCarthy
*Attorney, Agent, or Firm*—David L. Ray

[57] ABSTRACT

In accordance with the present invention there is provided a process for removing zebra mussels from rigid structures having water flowing therethrough including stopping the flow of water through the rigid structure and flowing steam through the rigid structure in the direction opposite to the direction in which water flowed through the rigid structure.

9 Claims, 2 Drawing Sheets

PROCESS FOR REMOVING ZEBRA MUSSELS FROM RIGID STRUCTURES

BACKGROUND OF THE INVENTION

1. Field of the Invention

The invention relates to cleaning rigid structures. More particularly, the present invention relates to removing mussels from rigid structures such as pipes, heat exchangers, and the like.

2. Description of the Related Art

Zebra mussels have caused extensive damage in the Great Lakes and Europe by attaching themselves to virtually any hard surface. Pumps, water lines, heat exchangers, and pipes using water from rivers and lakes are vulnerable to zebra mussel infestation. As the mussels grow, flow through pipes and tubes decreases rapidly. Zebra mussels in the Mississippi River have increased in numbers and now are infesting water drawn into chemical plants as far south as Louisiana.

It is known in the art to kill Zebra mussels in pipes by flowing chlorine or other chemicals therethrough. Furthermore, hot water or steam may used in selected areas for killing mussels as mentioned in U.S. Pat. No. 5,240,674.

When zebra mussels are removed from pipes and other structures, disposal of the dead mussels is costly and difficult. Chemicals used to remove the mussels are mixed with the mussels and can damage and pollute the environment.

Exemplary of the processes of the prior art related to removal of zebra mussels are the following U.S. Pat. Nos. 5,294,351; 5,240,674; 5,192,451; 5,152,637; 5,148,777; 5,128,050; 5,096,601; 5,062,967; and 4,324,784.

SUMMARY OF THE INVENTION

In accordance with the present invention there is provided a process for removing zebra mussels from rigid structures such as pipes, tubes, heat exchangers, and the like having water flowing therethrough including stopping the flow of water through the rigid structure and flowing steam through the rigid structure in the direction opposite to the direction in which water flowed through the rigid structure.

The invention has the advantage of removing zebra mussels without the use of chemicals, thereby eliminating environmental problems in disposing of the chemicals after use.

The invention has the further advantage of enabling return of dead and dying mussels removed from rigid structures to the body of water from which the mussels originated.

The invention has the additional advantage of removing zebra mussels quickly, easily, and at low cost without damage to the structure to which the zebra mussels are attached.

DESCRIPTION OF THE PREFERRED EMBODIMENTS

Figure 1:
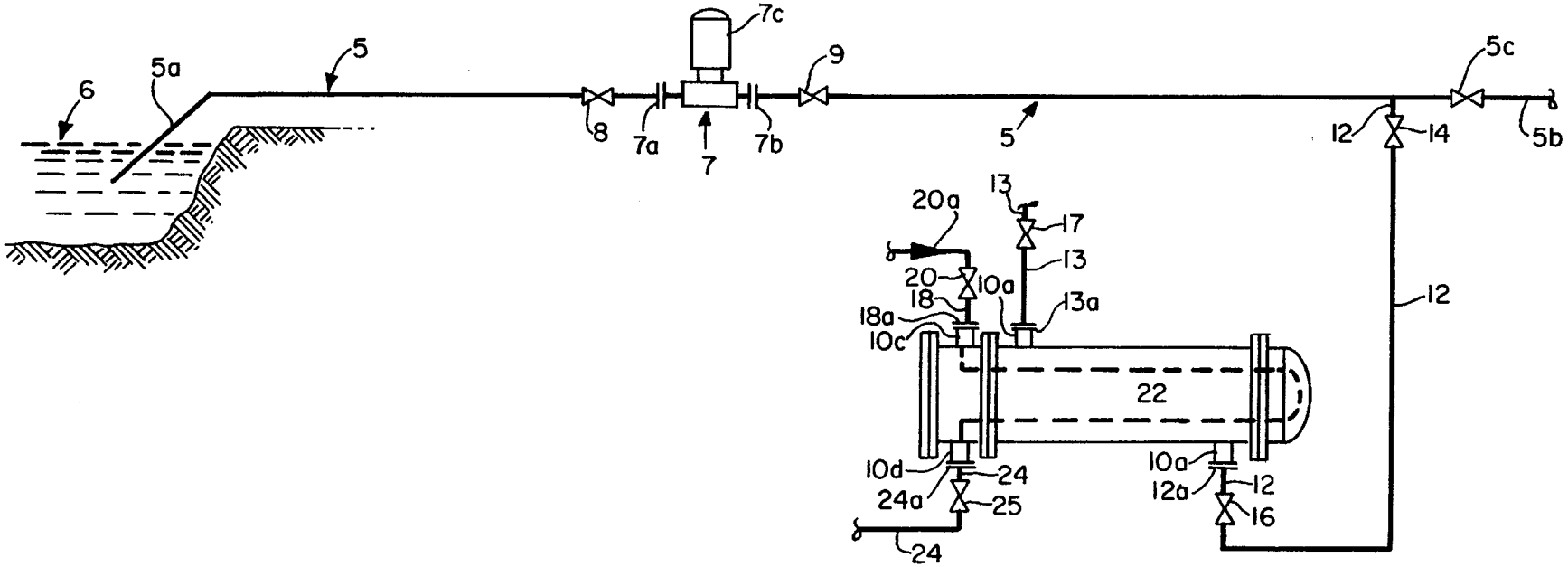
FIG. 1 is a schematic drawing of conventional piping, pump and heat exchanger in a chemical or manufacturing plant which uses water from a body of water containing zebra mussels.

In FIG. 1 is shown a typical water flow path through a chemical plant or other manufacturing plant of water pumped from a river, lake, or pond located adjacent to the plant.

A typical flow path through the plant includes a pipe generally indicated by the numeral 5 having an intake pipe 5*a* immersed in a body of water generally indicated by the numeral 6 for drawing water from the body of water 6, and an outlet end 5*b* for supplying water from the body of water 6 to other areas of the plant not shown. A valve 5*c* is connected to pipe 5 adjacent to outlet end 5*b* to selectively stop the flow of water to the portion of the plant not shown. The body of water 6 can be a river, lake, or pond which has zebra mussels and zebra mussel larvae therein.

Pipe 5 has a primary water intake pump generally indicated by the numeral 7 connected thereto by flanges 7*a* and 7*b* for pumping water from the body of water 6. As is known in the art, other secondary pumps not shown could be added to assist primary pump 7 if desired. Pump 7 is driven by motor 7*c* which may be any conventional motor such as an electric motor, internal combustion motor, or the like. Pipe 5 has valve 8 connected thereto on the inlet side of pump 7 and valve 9 connected on the outlet side of pump 7. Pump 7 supplies water from body of water 6 through pipe 5 to equipment requiring water such as the heat exchanger generally indicated by the numeral 10 and other equipment (not shown) such as other heat exchangers and fire extinguishing equipment utilized in chemical and manufacturing plants and mills located adjacent to the body of water 6.

Heat exchanger 10 is supplied with cooling water from pipe 5 by inlet pipe 12, and water supplied by pipe 12 exits through pipe 13 to a storage area such as a conventional sump or evaporation pond (not shown). Pipe 12 preferably has two valves 14 and 16 therein for selectively controlling the supply of water from pipe 5 to heat exchanger 10, valve 14 being preferably located adjacent to pipe 5 and valve 16 being located adjacent to heat exchanger 10. If desired, one of the two valves 14 or 16 could be omitted. Pipe 13 has a valve 17 therein for selectively controlling the flow of water from pipe 13. Pipe 12 is connected to inlet pipe 10*a* of heat exchanger 10 by flange 12*a*, and pipe 13 is connected to outlet pipe 10*b* of heat exchanger 10 by flange 13*a*.

Heat exchanger 10 has a hot fluid inlet pipe 18 having valve 20 therein for selectively controlling the flow of hot fluid through heat exchanger 10. Pipe 18 is connected to hot fluid inlet pipe 10*c* by flange 18*a*. The hot fluid flowing through fluid inlet pipe 18 could be a liquid or a gas utilized in some area of a chemical or manufacturing plant, or a mixture of liquid or gas which has a higher temperature than the water entering heat exchanger 10 through pipe 12. The temperature of the hot fluid is reduced by the heat exchanger to a temperature close to the temperature of the entering water. When valve 20 is opened, the hot fluid enters heat exchanger 10 in the direction of the arrow 20*a* and is conveyed therethrough by a pipe 22 indicated by dotted lines in heat exchanger 10 and exits heat exchanger 10 through hot fluid outlet pipe 10*d* which is connected by flange 24*a* to outlet pipe 24. Pipe 24 has valve 25 therein to selectively control the flow of liquids through pipe 24.

As the water flow described above takes place, zebra mussels contained in the body of water 6 produce larvae which enter pipes 5, 12, 13, and heat exchanger 10, attach themselves to the inside of pipes 5 and 12, and heat exchanger 10, and begin to grow. The mussels increase rapidly in size, thereby reducing flow rates through pipes 5, 12, 13, and heat exchanger 10. As the mussels continue to grow, flow may be greatly reduced and equipment damaged.

Figure 2:
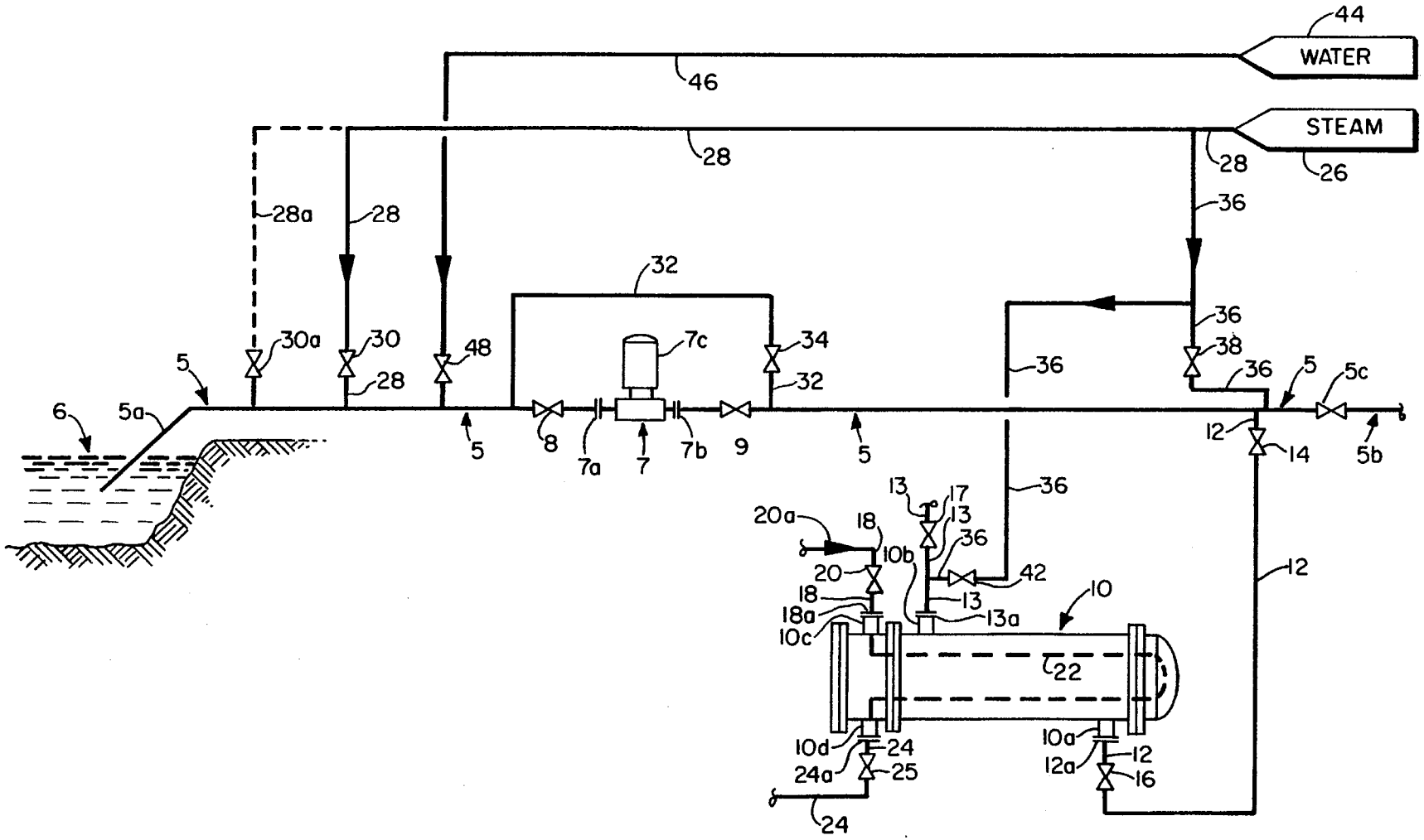
FIG. 2 a schematic drawing of the additions necessary to the piping, pump, and heat exchanger of FIG. 1 to use the invention to remove zebra mussels from the interior of the piping and heat exchanger of FIG. 1.

FIG. 2 shows the additions necessary to the piping of FIG. 1 to utilize the invention to remove zebra mussels from the piping and heat exchangers. Referring now to FIG. 2, a source of steam 26 such as a steam boiler or the like is connected by first steam pipe 28 having valve 30 therein to pipe 5 between pump 7 and inlet pipe 5*a*. Valve 30 would be closed when water is being pumped from body of water 6 by pump 7. If the distance between inlet pipe 5*a* and pump 7 is great, such as several hundred yards, a second pipe 28*a* indicated by dotted lines having valve 30*a* may be connected to pipe 5. Valve 30*a* would be closed when water is being pumped from body of water 6 by pump 7. A bypass pipe 32 having valve 34 connected thereto is connected to pipe 5 on the inlet side of valve 8 and the outlet side of valve 9, thereby enabling selective flow of liquids around pump 7. Valve 34 would be closed when water is being pumped from body of water 6 by pump 7.

Steam source 26 may be selected to supply steam at any desired pressure, temperature and volume necessary to remove attached mussels from the interior of pipes and heat exchangers or other structures to which zebra mussels are attached. Furthermore, the length of time of the flow of steam may be varied as needed to remove all zebra mussels. If desired, a separate water pipe may be connected to areas of the chemical or manufacturing plant not being flushed with steam to prevent a complete stoppage of all area and equipment in the plant.

A second steam pipe 36 is connected to pipe 28 between boiler 26 and valve 30 and to pipe 5 between valve 5*c* and valve 9. Pipe 36 has valve 38 connected thereto to selectively control the flow of steam therethrough. Valve 38 would be closed when water is being pumped from body of water 6 by pump 7. Steam pipe 36 is also connected to pipe 13 between heat exchanger 10 and valve 17 and has valve 42 connected thereto. Valve 42 would be closed when water is being pumped from body of water 6 by pump 7.

A source of water 44 under superatmospheric pressure having valve 48 connected thereto may be connected to pipe 5 to provide a source of water to pipe 5 to prime pump 7 when pump 7 initially begins to pump water from the body of water 6 through inlet pipe 5*a*. Valve 48 would be closed when water is being pumped from body of water 6 by pump 7.

In accordance with the present invention, to remove zebra mussels from the portion of pipe 5 between pump 7 and outlet pipe 5*a*, pump 7 is turned off, valve 8 is closed, valves 30*a*, 34, 38, 42, and 48 remain closed, and valve 30 is opened. Steam from steam source 26 flows through pipe 28 and valve 30 to pipe 5, and exits through pipe inlet 5*a* into the body of water 6. Thus, steam flows from the connection of pipe 28 and pipe 5 to inlet pipe 5*a* in a direction opposite to the direction of flow of water through pipe when water from the body of water 6 is flowing into pipe 5, thereby killing and removing zebra mussels attached to the interior of pipe 5. The flow of steam through pipe 5 in the direction of flow opposite to the flow of water through pipe 5 forces mussels removed from the interior of pipe 5 to flow into the body of water 6. The same procedure could be utilized with line 28*a* and 30*a* if they are added to pipe 5.

After mussels have been removed from the portion of pipe 5 between pump 7 and inlet pipe 5*a*, valve 8 is opened and valves 30 and 34 are closed. Valve 48 is opened to admit water under pressure into line 5 from water source 44, and pump 7 is started. After pump 7 is running and pumping water from body of water 6, valve 48 is closed and operation can continue as described in the explanation of FIG. 1.

To remove zebra mussels from the heat exchanger 10 in accordance with the present invention, pump 7 is turned off, valves 5*c*, 8, 9, and 17 are closed, valves 30, 30*a*, 38, and 48 remain closed, valves 14 and 16 remain open, and valves 34 and 42 are opened. Steam from steam source 26 flows through pipes 28 to pipe 36 and valve 42 to pipe 13, from pipe 13 into heat exchanger 10. Steam from heat exchanger 10 exits from heat exchanger 10 through pipe 12 and flows through valves 16 and 14 into pipe 5. Steam from pipe 5 flows through pipe 32 and valve 34 to bypass pump 7, and re-enters pipe 5 to flow into inlet pipe 5*a* and onward into the body of water 6. Thus, steam flows through heat exchanger 10 into pipe 12 and into pipe 5 in a direction opposite to the direction of flow of water through pipes 12 and 5 when water from the body of water 6 is flowing into pipes 5 and 12, thereby killing and removing zebra mussels attached to the interior of heat exchanger 10 and pipes 12 and 5. The flow of steam through heat exchanger 10 and pipes 12 and 5 in the direction of flow opposite to the flow of water through heat exchanger and pipes 5 and 12 forces mussels removed from the interior of heat exchanger 10 and pipes 12 and 5 to flow into the body of water 6.

If mussels removed from heat exchanger 10 accumulate in pipe 5 near the connection of pipe 12 to pipe 5 due to pipe 5 being larger in diameter than pipe 12, valves 14 and 42 are closed, valves 5*c*, 8, 9, 30*a*, 30, 48 remain closed, valve 34 remains open, and valve 36 is opened to introduce a sufficient volume of steam at a sufficient pressure to force mussels accumulating near the connection of pipe 12 to pipe 5 through pipe 5 to pipe 32, through valve 34 and pipe 32 to pipe 5, and through pipe 5 to and inlet pipe 5*a* to body of water 6.

Since the mussels have not been chemically treated and contain no chemical residue harmful to the environment, the dead mussels fall harmlessly to the bottom of the body of water 6 and cause no environmental damage. The dead mussels accumulate on the bottom of body of water as they would in their normal life cycle in the body of water and provide food for feeding organisms contained in the body of water such as fish, turtles, shrimp, and the like.

After the mussels have been removed from the heat exchanger 10 and pipes 12 and 5, valves 5*c*, 8, 9, and 17 are opened, valves 30, 30*a*, 38, and 48 remain closed, valves 14 and 16 remain open, and valves 34 and 42 are closed. Valve 48 is opened to admit water under pressure into line 5 from water source 44, and pump 7 is started. After pump 7 is running and pumping water from body of water 6, valve 48 is closed and operation can continue as described in the explanation of FIG. 1.

Furthermore, other equipment in addition to pipes and heat exchangers may have steam directed therethrough in a direction opposite to the flow of water therethrough to remove zebra mussels therefrom.

Although the preferred embodiments of the invention have been described in detail above, it should be understood that the invention is in no sense limited thereby, and its scope is to be determined by that of the following claims:

What is claimed is:

1. A process for removing mussels from a rigid structure through which water flows from a body of water containing zebra mussels comprising:

a. stopping the flow of water from said body of water through said rigid structure, b. directing steam through said rigid structure in a direction opposite to the direction in which water flows through said rigid structure, said steam having a temperature and pressure sufficient to remove said mussels from said pipes and heat exchangers, for a period of time sufficient to remove said mussels from said structure, c. conveying said steam and zebra mussels removed said structure to said body of water, and d. discharging said steam and zebra mussels removed from said structure into said body of water.

2. A process for removing mussels from a rigid structure through which water flows from a body of water containing zebra mussels comprising:

a. stopping the flow of water from said body of water through said rigid structure, b. directing a fluid consisting of steam through said rigid structure in a direction opposite to the direction in which water flows through said rigid structure, said steam having a temperature and pressure sufficient to remove said mussels from said pipes and heat exchangers, for a period of time sufficient to remove said mussels from said structure, c. conveying said steam and zebra mussels removed from said structure to said body of water, and d. discharging said steam and zebra mussels removed from said structure into said body of water.

3. A process for removing mussels from a rigid structure through which water flows from a body of water containing zebra mussels comprising:

a. stopping the flow of water from said body of water through said rigid structure, b. directing a fluid consisting essentially of steam through said rigid structure in a direction opposite to the direction in which water flows through said rigid structure, said steam having a temperature and pressure sufficient to remove said mussels from said pipes and heat exchangers, for a period of time sufficient to remove said mussels from said structure, c. conveying said steam and zebra mussels removed from said structure to said body of water, and d. discharging said steam and zebra mussels removed said structure into said body of water.

4. The process of claim 3 wherein said structure is a pipe.

5. The process of claim 3 wherein said structure is a heat exchanger.

6. The process of claim 1 wherein said structure is a pipe.

7. The process of claim 1 wherein said structure is a heat exchanger.

8. The process of claim 2 wherein said structure is a pipe.

9. The process of claim 2 wherein said structure is a heat exchanger.

* * * * *

UNITED STATES PATENT AND TRADEMARK OFFICE

CERTIFICATE OF CORRECTION

PATENT NO. : 5,558,108

DATED : September 24, 1996

INVENTOR(S) : Ted B. Croswell, Sr.

It is certified that error appears in the above-identified patent and that said Letters Patent is hereby corrected as shown below:

In claim 1, subparagraph "c"., column 5, line 3, insert the word--from--after the word "removed" and before the word "said".

In claim 3, subparagraph "d"., column 6, line 12, insert the word--from--after the wrod "removed" and before the word "said".

Column 4, line 25, change "36" to --38--.

Signed and Sealed this

First Day of April, 1997

Bruce Lehman

*Attest:*

BRUCE LEHMAN

*Attesting Officer*

*Commissioner of Patents and Trademarks*